US007591049B2

(12) United States Patent
Cooper et al.

(10) Patent No.: US 7,591,049 B2
(45) Date of Patent: Sep. 22, 2009

(54) TEXTILE LAPPING MACHINE

(75) Inventors: Jason Ian Cooper, Hallam (AU); Eric Roberts, Sunbury (AU)

(73) Assignee: V-Lap Pty. Ltd., Cheltenham, Victoria (AU)

( * ) Notice: Subject to any disclaimer, the term of this patent is extended or adjusted under 35 U.S.C. 154(b) by 109 days.

(21) Appl. No.: 11/817,555

(22) PCT Filed: Mar. 2, 2006

(86) PCT No.: PCT/AU2006/000316

§ 371 (c)(1),
(2), (4) Date: Nov. 5, 2007

(87) PCT Pub. No.: WO2006/092029

PCT Pub. Date: Sep. 8, 2006

(65) Prior Publication Data

US 2008/0155787 A1 Jul. 3, 2008

(30) Foreign Application Priority Data

Mar. 2, 2005 (AU) ..... 2005900983

(51) Int. Cl.
*D01G 25/00* (2006.01)

(52) U.S. Cl. ..... 19/296; 19/302; 19/163

(58) Field of Classification Search ..... 19/296, 19/302, 161.1, 163
See application file for complete search history.

(56) References Cited

U.S. PATENT DOCUMENTS 5,120,376 A * 6/1992 Hong ..... 156/73.1
5,558,924 A * 9/1996 Chien et al. ..... 428/181
5,955,174 A 9/1999 Wadsworth et al.

FOREIGN PATENT DOCUMENTS

EP 1065307 1/2001

* cited by examiner

*Primary Examiner*—Shaun R Hurley
(74) *Attorney, Agent, or Firm*—Smith-Hill & Bedell, P.C.

(57) ABSTRACT

A textile lapping machine has an inclined reciprocating comb which deposits a vertically descending fibrous web onto a mesh belt of an endless conveyor which travels through an oven. A reciprocating presser bar pushes the pleats formed by the comb into a shark unit which extends across the width of the mesh belt. The unit has a toothed plate which initially slows the pleated web and longitudinal fingers which overlie the conveyor and form a shallow lapping zone. A textile card delivers the fibrous web to the lapping zone and the oven fuses any low melt synthetic fibers in the web to the surrounding fibers to give a batt with a density of 80-2000 gsm. The comb path direction remains constant and the presser bar and shark unit are moved towards and away from the comb. The drives to the comb and presser bar are independent.

27 Claims, 8 Drawing Sheets

TEXTILE LAPPING MACHINE

This is a national stage application filed under 35 USC 371 based on International Application No. PCT/AU2006/000316 filed Mar. 2, 2006, and claims priority under 35 USC 119 of Australian Patent Application No. 2005900933 filed Mar. 2, 2005.

FIELD OF THE INVENTION

This invention concerns textile lapping machines.

BACKGROUND OF THE INVENTION

Some machines produce non-woven continuous mat-like product direct from a carding machine in widths from 500-3000 mm.

In U.S. Pat. No. 5,955,174 a vibrating perpendicular lapper receives a carded web from a feed unit consisting of a wire grid and a guide board which direct the web on to a conveyor belt. The forming comb of the lapper is driven by a bell crank from a gearbox. The same gearbox drives another bell crank which operates a presser bar. As the web is introduced from the conveyor into the path of the lapper, the comb and presser bar alternately act on the web to impose vertical parallel pleats on the web which are then compressed to build a pleated web. The pleated web is joined face to face with a second adhesive web and a laminated composite web is created. The composite web then feeds into an oven on a conveyor belt.

SUMMARY OF THE INVENTION

The apparatus aspect of the invention provides a fibrous web pleating apparatus for a textile lapping machine comprising a reciprocable comb assembly including drive means to reciprocate the comb, a presser bar assembly including drive means to reciprocate the presser bar wherein the comb drive means and the presser bar drive means are devoid of mechanical coupling.

The drives may be driven from a common source but the drives are not linked.

The drivers may utilise a common motor but these assemblies remain capable of independent adjustment. The motor may rotate the reciprocating parts of both drives through chain transmission or belt transmission, preferably toothed belt.

The comb driver is capable of stroke adjustment in order to build material varying in thickness from 10-55 mm. The comb may be reciprocated by a pair of cranks driven by a common shaft. The comb assembly including the drive may be mounted as a unit so as to be movable toward and away from the feed path of the fibrous web.

The angle of the assembly in relation to the feed path of the fibrous web may be adjustable.

The presser bar reciprocates in a plane inclined at 70-100° to the axis of web travel to the comb. The plane may be horizontal enabling the web to be introduced from overhead to a generally upright comb. After the lapping assembly has built the web into a batt ribbon 500 mm wide, the ribbon is carried into an oven on an endless conveyor. The presser bar may have two rows of needles. These act to push fibres through the loops in known manner.

The fibrous web is presented to the lapping assembly by an apron feed device which takes the output of a card. The fibrous web may be fed to lapping zone by a slide plate which is preferably inclined to the reciprocating path of the comb.

The comb reciprocates between adjustable guides adjustable toward and away from the leading end of the comb. Part of the lapping zone may be defined by the surface of a conveyor which takes the batt into the oven.

The presser bar may be set to reciprocate above the surface of the lapping zone with a clearance of 1-4 mm allowing relatively thin batts to be built. The bar may be inclined from the vertical, lying substantially parallel to the slide plate which feeds the fibrous web. The bar may have twin rows of needles.

The initial upstream path of the lapping zone may have a toothed surface spaced from and substantially parallel to the conveyor surface. The teeth may project into the top face of the lapped batt. The width of the teeth may mimic the lap width in the batt. Accordingly the teeth may be exchanged for teeth of a width suitable to the batt which is built. The transfer zone downstream of the lapping zone in the direction of the oven may be defined by fingers disposed parallel to the feed direction of the conveyor.

The fingers may be connected to multiple transverse stabiliser rods. If a lapped product is wider than the width of the carded web, two lapping assemblies are installed side by side.

BRIEF DESCRIPTION OF THE DRAWINGS

One embodiment of the invention is now described with reference to the accompanying drawings, in which.

DETAILED DESCRIPTION WITH RESPECT TO THE DRAWINGS

Figure 1:
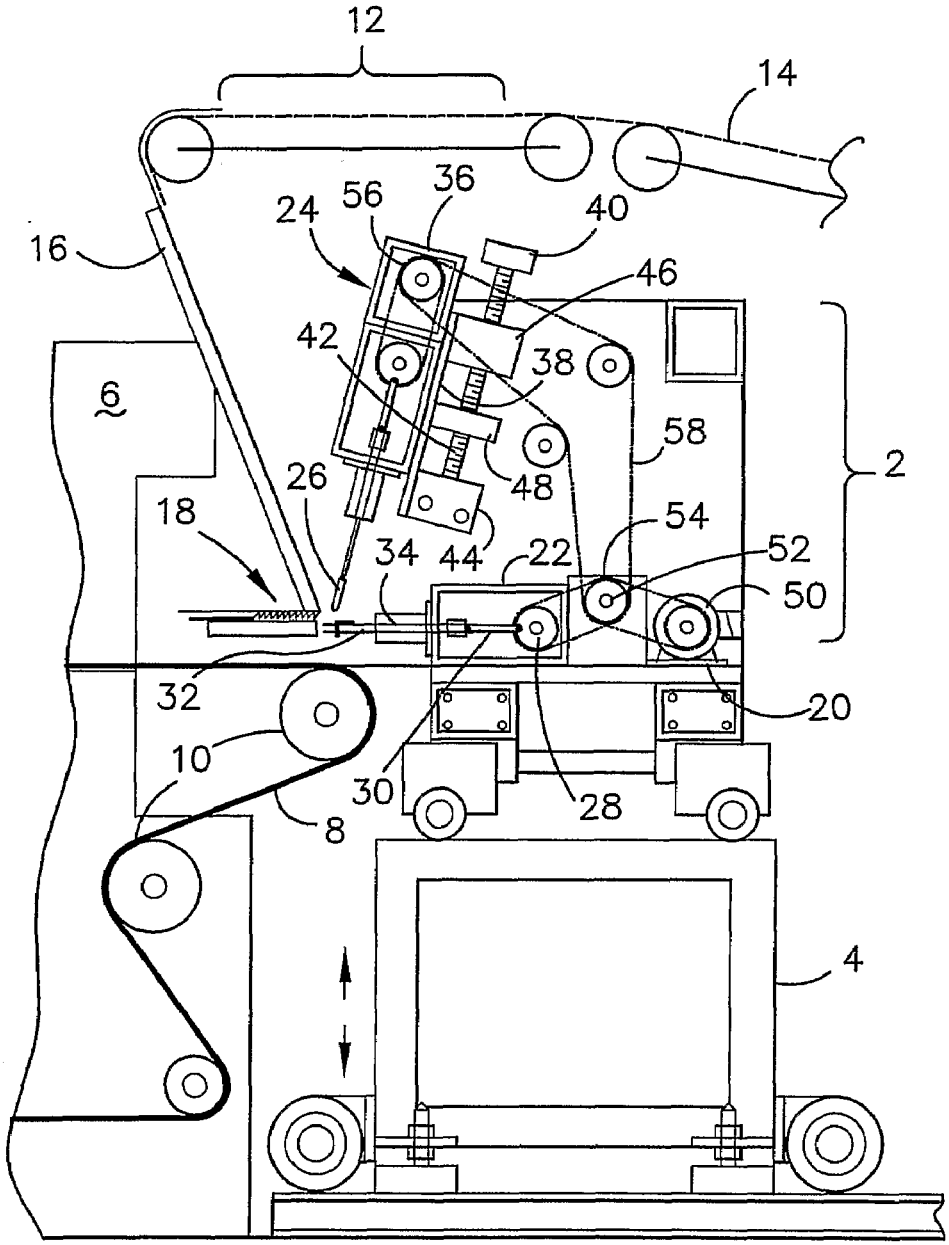
FIG. 1 is a diagrammatic side view of the lapping machine.

The lapping machine in the drawings is fed with a fibrous web made by the combination of a fibre opener and blender, a cross-lapper and a finish card operating in series. The plated web proceeding from the lapping machine enters an oven usually 2-5 m maximum width where the fibres in the web bond to a greater or lesser extent depending on dwell time, temperature and the type of fibre. The oven treatment creates a springy, dimensionally stable ribbon product capable of being wound into rolls or cut into sheets of 50-2500 gsm.

Referring now to FIG. 1, the lapper assembly 2 is mounted on a wheeled carriage 4 which allows the assembly to be moved toward and away from the oven 6. The endless mesh conveyor 8 is threaded over feed rolls 10 and travels at 0.84 m/min. An overhead articulated card web infeed 12 conveys fibrous web 14 from a card (not shown). The infeed deposits the web onto a front inclined slide plate 16 which descends to the lapping zone 18 on the oven conveyor.

The box-like lapper assembly has a horizontal base 20 on which is mounted a presser bar sub-assembly 22 and an inclined overhead sub-assembly 24 holding the reciprocating comb 26 at an angle of about 50° to a front inclined slide plate 16. The presser bar sub-assembly 22 contains a horizontal crank 28 which drives connecting rod 30. The presser bar 32 is fixed to the end of reciprocable slide 34 (see FIG. 3).

The overhead comb sub-assembly 24 consists of a frame 36 which rises and falls on inclined bed 38. Handwheel 40 controls a screw 42 which rotates in block mounts 44, 46 which are part of the box like lapper assembly. A nut 48 projects from the frame 36 and engages screw 42 enabling the frame to be wound toward and away from the lapping zone 18. A1HP electric motor 50 drives main shaft 52 which turns first toothed wheel 54 and a second toothed wheel (not shown). The first toothed wheel 54 drives toothed wheel 52 by a toothed belt 58. The second toothed wheel drives a crank pulley (not shown) and the crank 28 actuates the presser bar.

Figure 2:
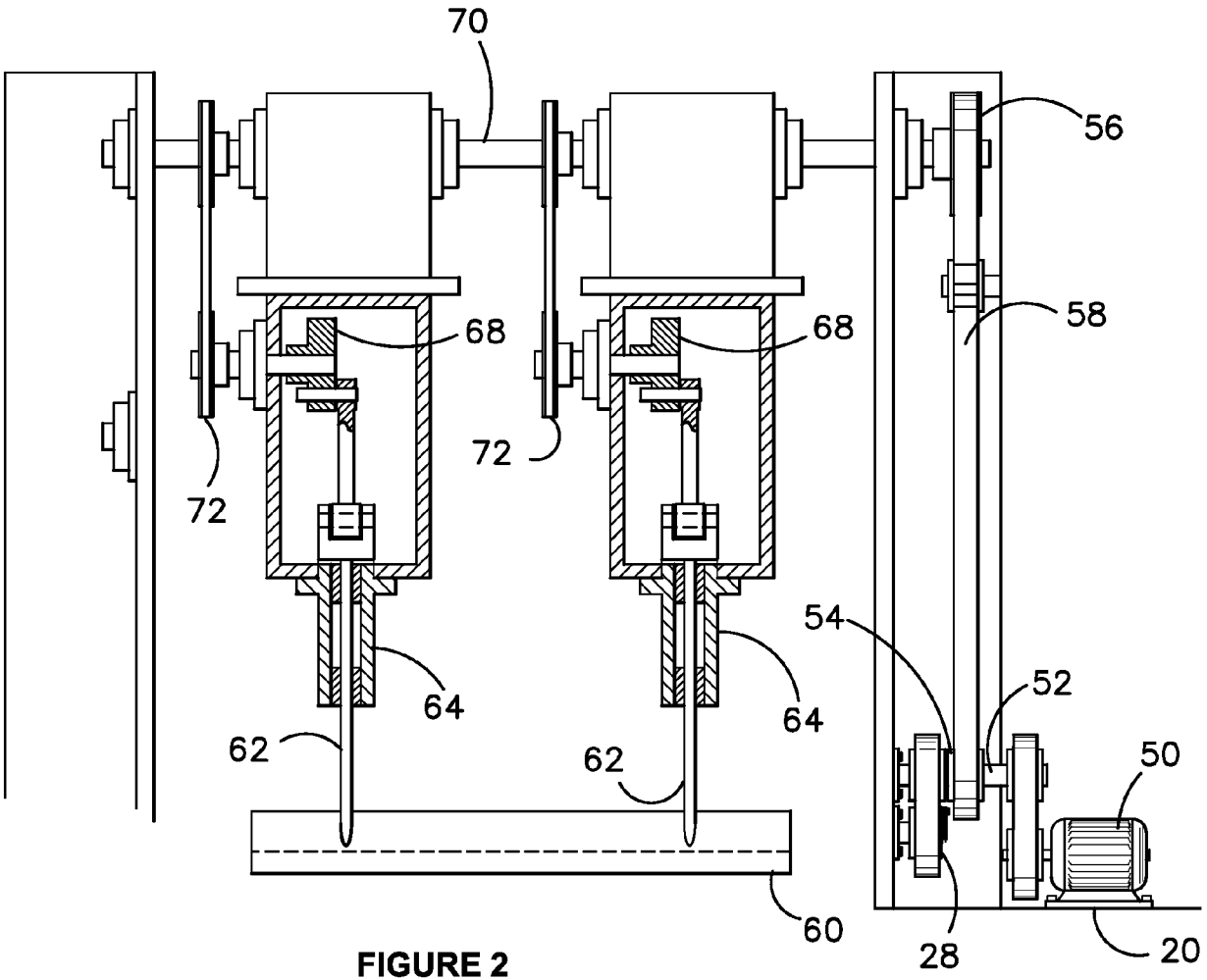
FIG. 2 is a diagrammatic front view of the comb drive.

Referring now to FIG. 2, the steel comb 60 is 500 mm wide and 75 mm deep. The comb is fixed to a pair of push rods 62 which ride in housings 64 projecting from frame 36. Connecting rods 66 reciprocated by cranks 68 both driven from a common shaft 70 carrying toothed wheel 56. Pulleys 72 drive the cranks 68 from shaft 70. The comb reciprocation can be adjusted through switchboard controls between 100-2000 strokes/min.

The drives to the comb and presser bar are arranged to actuate the comb and bar to give a build motion in known manner.

Figure 3:
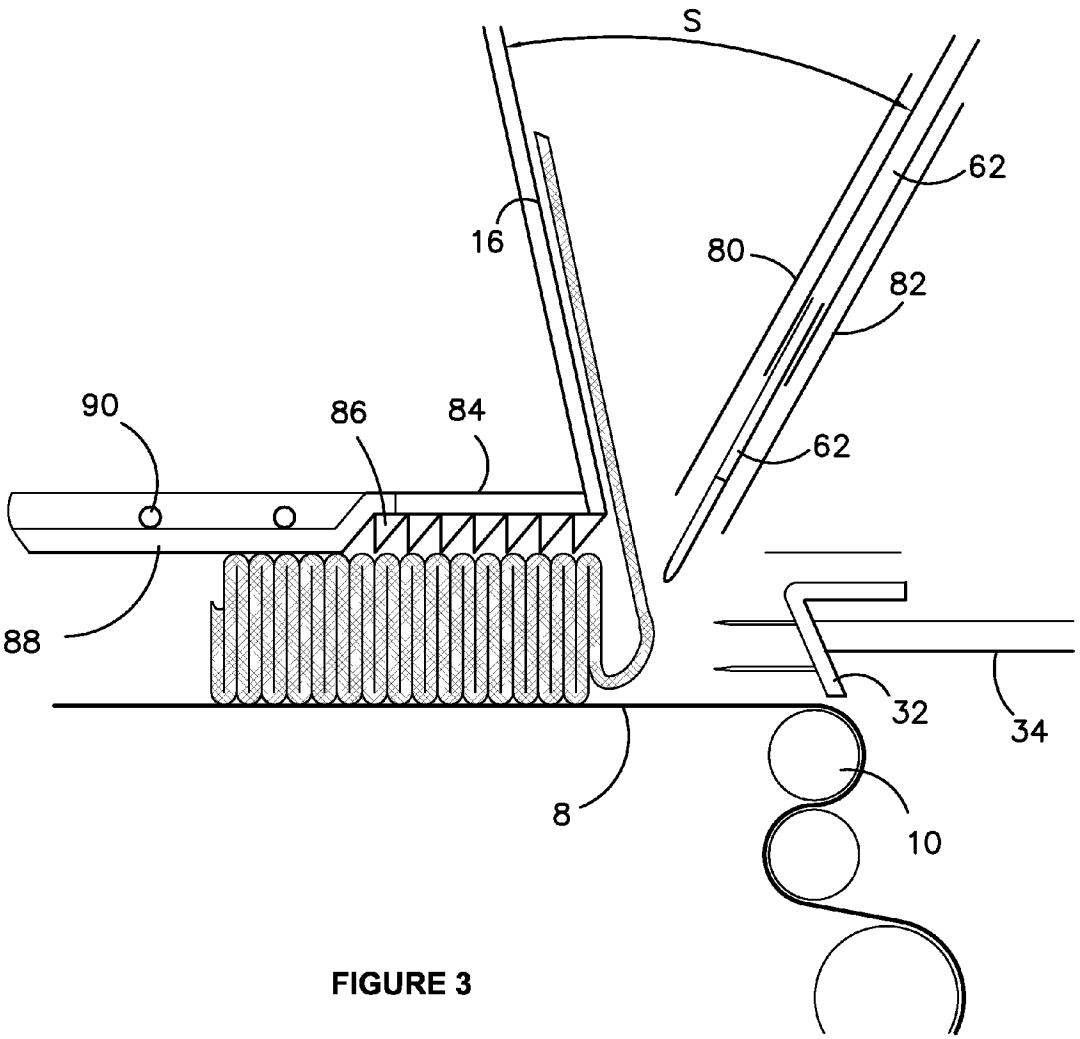
FIG. 3 is an enlarged view of the lapping zone.

The lapping zone is now described with reference to FIG. 3. The comb path and slide plate 16 are inclined at about 70° to the horizontal lying between them at an angle of separation (S) of about 40°. The comb itself moves between a front guide plate 80 and a rear guide plate 82 which extend from the frame 36. The plates are slidable toward and away from the lapping zone to render the comb motion very precise. The comb itself is adjustable on the push rods to achieve 90° register with the edges of the fibrous web.

The lower end of the infeed slide plate 16 supports a shark plate 84 with rows of teeth 86. These are adjustable toward and away from the surface of the oven belt in order to match the stroke of the comb. The shark plate extends for 70 mm whereafter the lapped web moves beneath a cage consisting of multiple fingers 88 joined by stabiliser bars 90 extending transversely to the direction of the conveyor feed. The cage is 130 mm long.

In another embodiment, the slide plate 16 may be replaced by a dual face to face belt system which controls the webs' introduction into the lapping zone 18 enabling the use of light web weights.

Static Comb Version

Referring now to FIGS. 4-7, the base 20 has a pair of cantilevered arms 100 which straddles the conveyor (not shown). Both base and arms are supported by a pair of screw jacks 102. Both jacks are driven by a common motor 104 through worm reduction gearboxes 106. Arms 100 support a pair of wheeled shark plate units 108 located in series in the feed path from the comb to the oven. The shark plate 84 and the cage fingers 88 are made to rise and fall by screw adjusters 110. Whereas the jacks produce initial set up movement of the arms 100, the adjusters 110 produce tuning movements towards and away from the conveyor which constitutes the lower guide surface for the pleated batt. The sides 112 of the batt are not confined. The units 108 can be unlocked from arms 100 by eccentric clamp 114 and rolled toward and away from comb 60 at the entry end of the lapping zone. For long runs, stops 116 are clamped to the arms 100.

Figure 4:
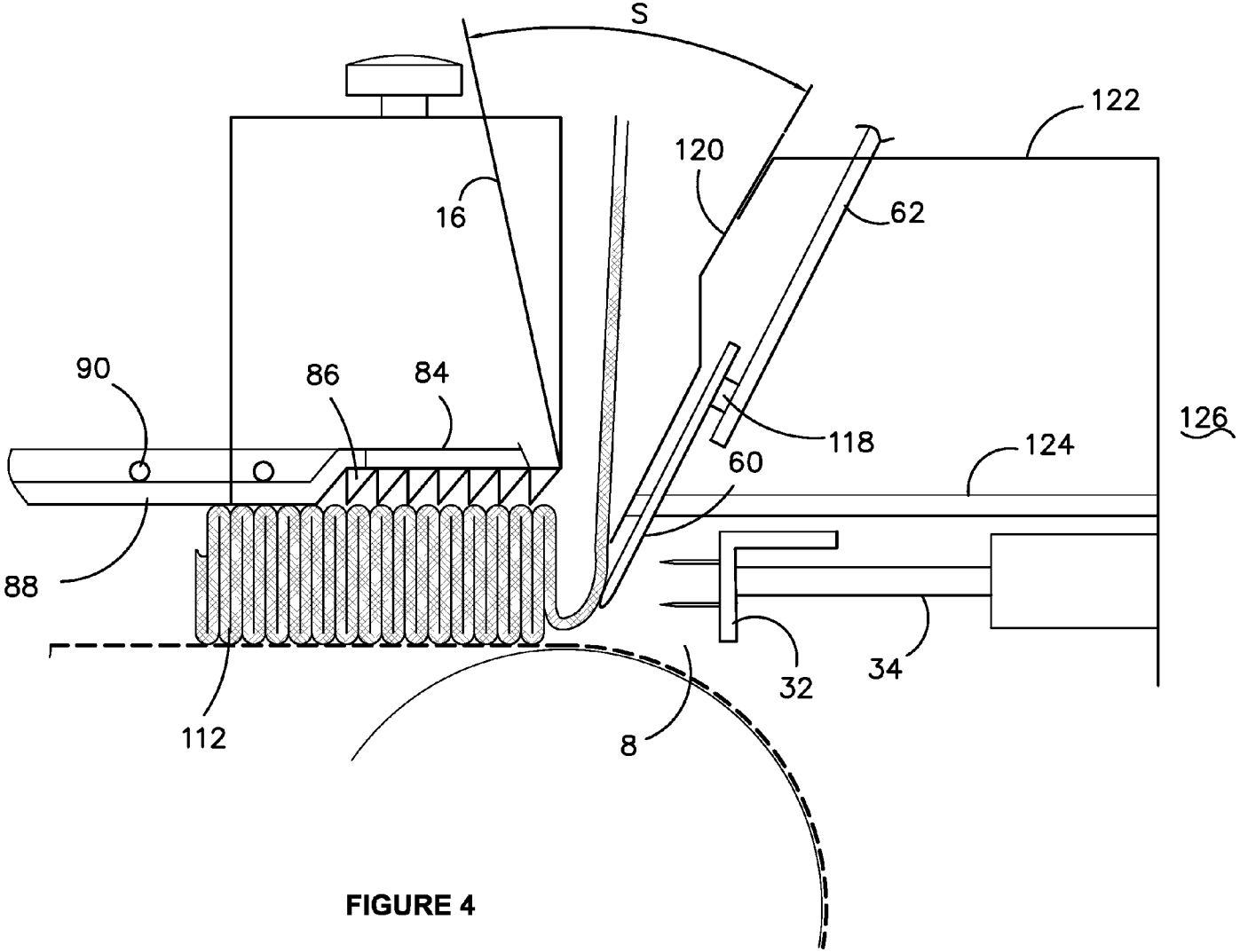
FIG. 4 is a enlarged view of the lapping zone of a variant lapping machine.
Figure 5:
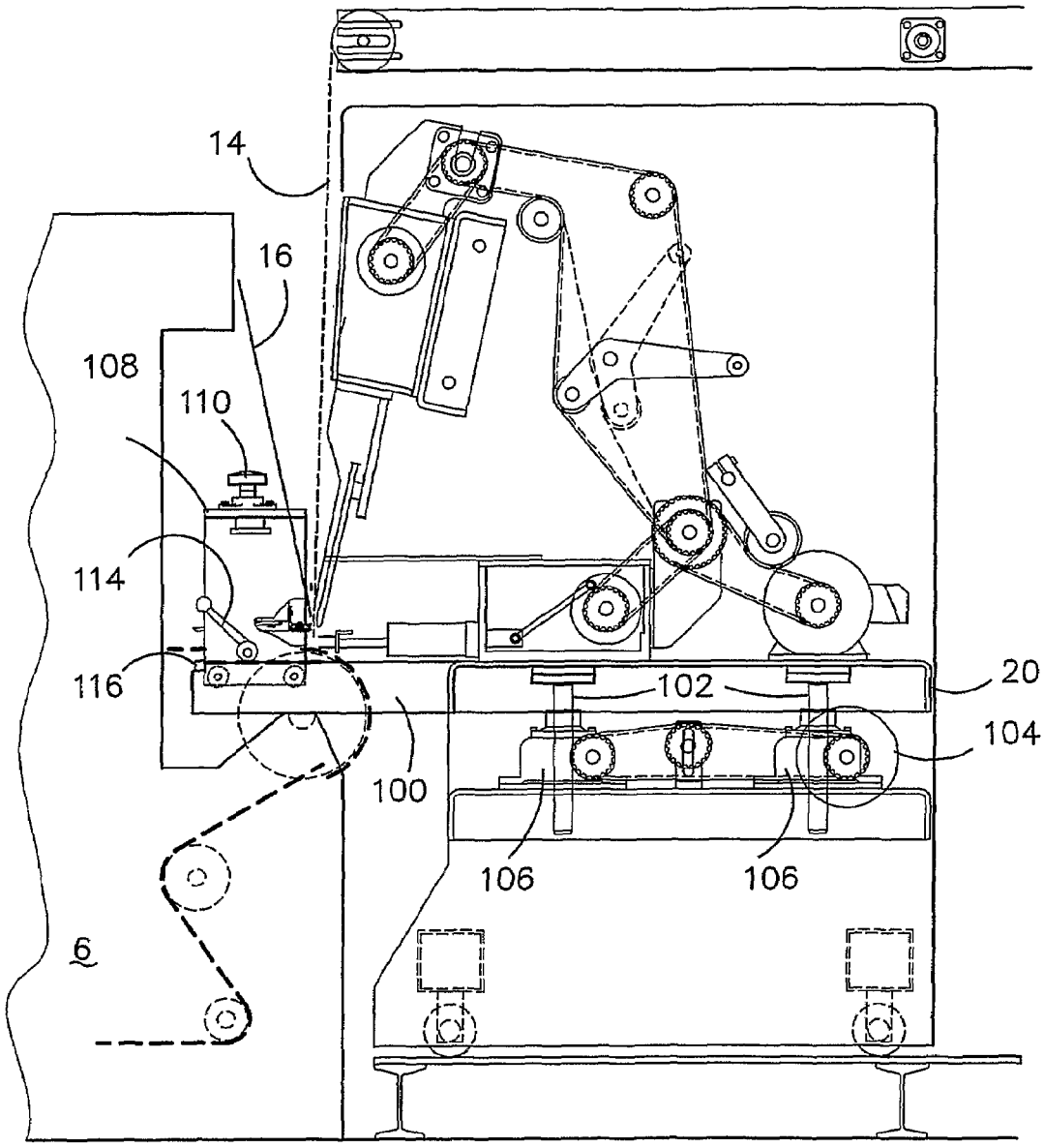
FIG. 5 is a diagrammatic side view of a variant lapping machine of which the lapper of FIG. 4 is a part.
Figure 6:
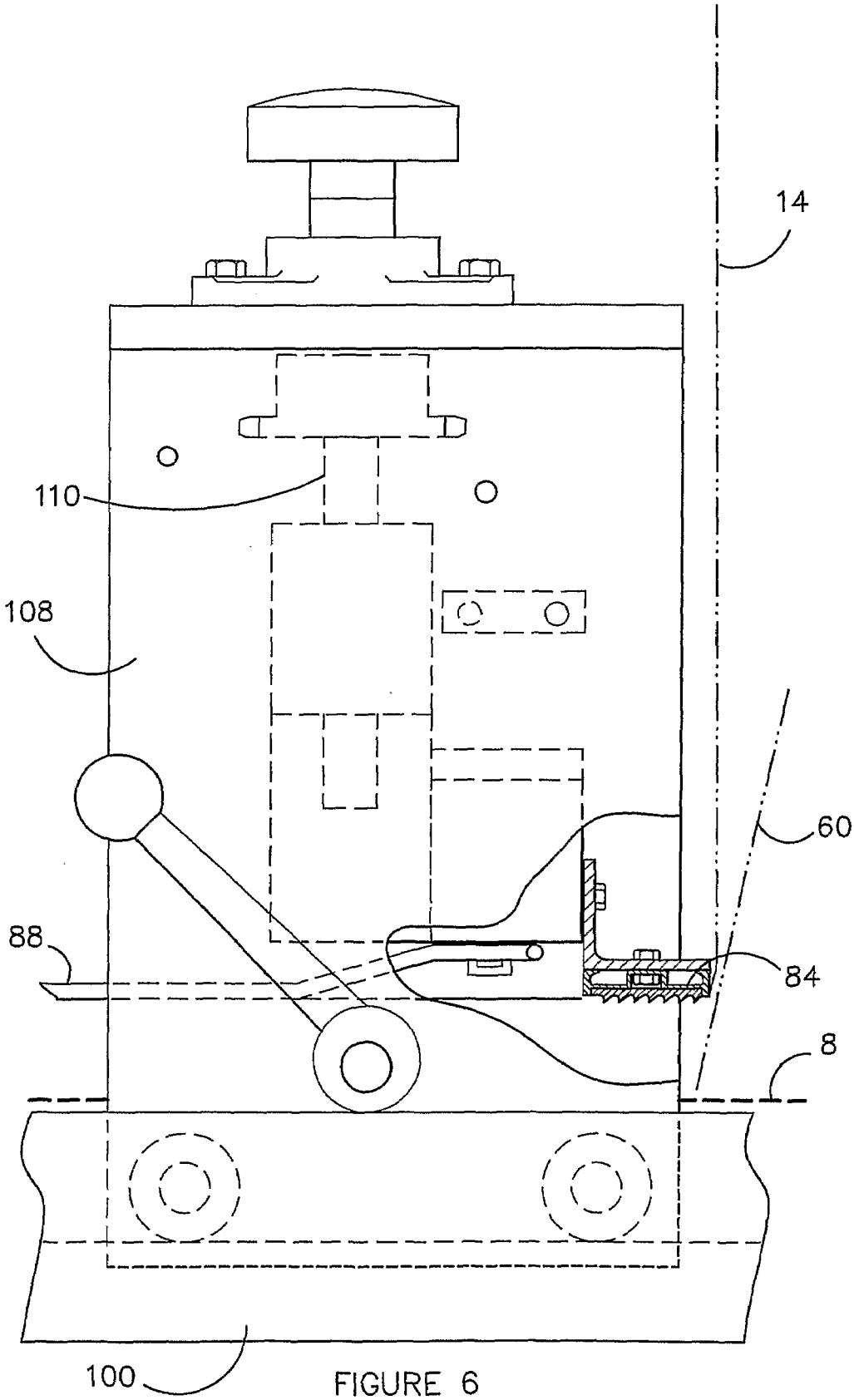
FIG. 6 is a diagrammatic side view of a single shark unit partly cut away.
Figure 7:
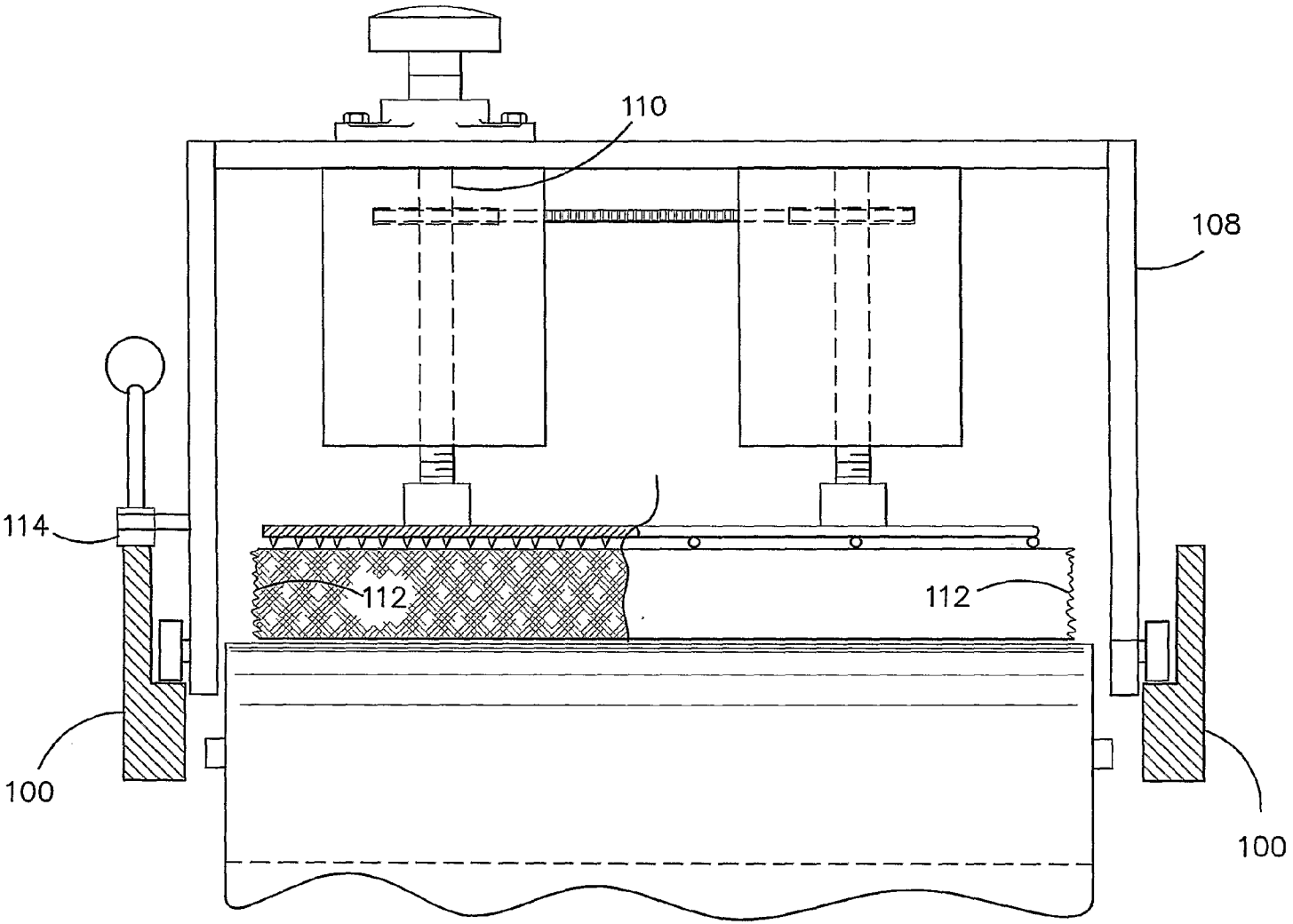
FIG. 7 is a diagrammatic end view of the shark unit in FIG. 5.

Accordingly in this embodiment the sub-assembly 24 is non-adjustable but the stroke of the comb remains adjustable. The comb is secured by spacer screws 118 to the push rods. A rear induced slide plate 120 is mounted on upper bracket 122 and lower bracket 124 which extend from the structural part 126 of the lapper. The web path bisects the angle between the front and rear slide plates and is substantially vertical. The comb reciprocates just behind the rear inclined slide plate 120 forming pleats as shown in FIG. 4. Wherever possible the path of the comb is left undisturbed. The push rod motion produces a very precise comb path and very reliable pleating. The comb itself is adjustable on the push rods to achieve 90° register with the edge 112 of the fibrous web. These tend to be somewhat irregular and fluffy but in subsequent manufacture they are trimmed by a cutter (not shown).

In another embodiment of the invention, the lapper assembly 20 has an independent height adjustment. By allowing the lapper assembly and shark unit to be raised or lowered and allowing the comb adjustment 36 to remain stationary quick changing of presser bars is possible.

Connecting rods 66 and the cranks 68 to be changed. This allows for the increase or decrease of the gearbox stroke and therefore allows the increase or decrease of the comb and presser bar stroke to be modified to allow both a greater or lower height of product to be achieved.

In a non-illustrated embodiment, the hot pleated web emerges from the oven into the nip of a pair of driven rolls which increase the web density. On emerging from the nip the web is cooled by passage through a zone where a fan draws air through the compressed web. This sets the synthetic fibres and the web does not reassume its former thickness.

If the comb is exchanged for one of lesser depth, the adjustment sequence is as follows:

1. The presser bar and shark unit are raised in unison using the jacks 102.
2. The presser bar stroke is adjusted to move the bar close to the comb.
3. The shark unit is moved close to the comb.
4. The shark plate unit is unclamped and moved forward in the direction of feed 8 to ensure the web feeds in correctly.

Figure 8:
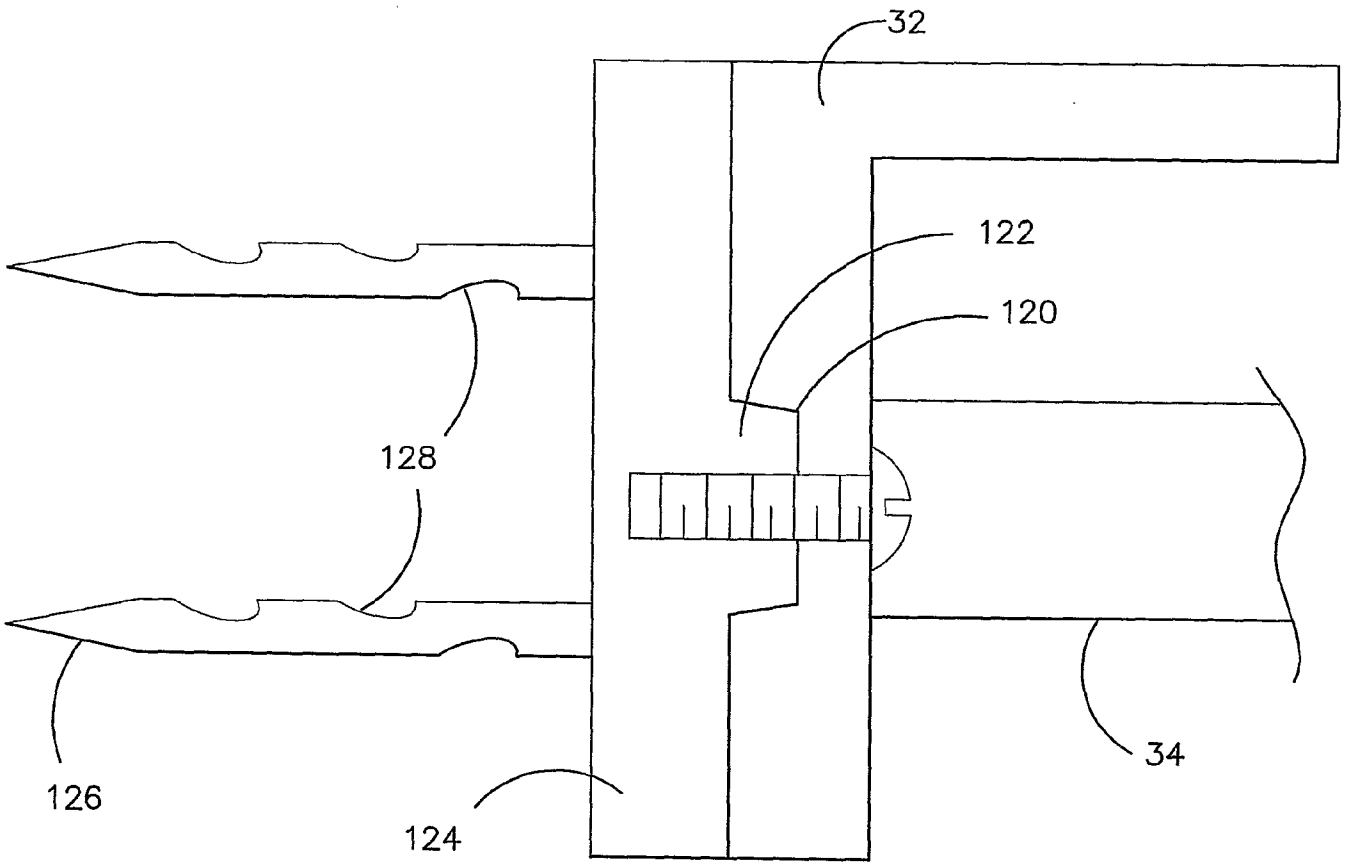
FIG. 8 is an enlarged side view of the presser bar needles.

Referring now to FIG. 8, the presser bar 32 is of inverted L-section. The front face has a slot 120 which receives the rib 122 of a plate 124 from which needles 126 project in two rows. The needles have ground incisions 128 which act as barbs and push fibres through the web pleats. The plate is exchangeable for a plate with plain needles.

In operation, the lapper is adjusted to produce the thickness, density and textile composition which is desired. A suitable blend of natural and synthetic fibre is contributed by a conventional bale breaker and blender. This mix is available to the card which delivers a fibrous web to the lapping machine at 70-100 m/min. The switchboard controls allow motor speed adjustment to match the infeed speed at the comb. The pleating reduces the feed speed which is of the order of 1 m/min. Product thickness varies between 5-55 mm and density varies between 50 gsm and 2000 gsm. The comb width may be 500-3000 mm. The comb depth may be 75-150 mm.

In a variant, the lapping zone is modified in that the pleated web is deposited onto a miniature driven conveyor which is part of the lapping unit instead of depositing onto the oven conveyor.

We have found the advantages of the above embodiment to be:

1. The presser bar operates very close to the conveyor allowing batts of minimum thickness to be built.
2. Once the comb stroke is selected, the presser bar and the parts surrounding the lapping zone can be easily moved close to the comb without disturbing the set up of the machine.
3. The deposition of the pleated web onto a continuously moving conveyor improves the build.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. these modifications and/or additions are therefore considered to fall within the scope of the invention.

The claims defining the invention are as follows:

1. A textile lapping machine for making pleated fibrous webs comprising a reciprocable comb assembly which includes drive means to reciprocate the comb, a presser bar assembly which includes drive means to reciprocate the presser bar, wherein the comb drive means and the presser bar drive means are devoid of mechanical coupling.

2. A textile lapping machine as claimed in claim 1, wherein the comb drive and the presser bar drive are served by a common motor.

3. A textile lapping machine as claimed in claim 2, wherein the comb drive and the presser bar drive are independently adjustable.

4. A textile lapping machine as claimed in claim 3, wherein the drives both have reciprocating parts and the motor drives the parts through one of a chain transmission V-belt and toothed belt.

5. A textile lapping machine as claimed in claim 1, wherein the fibrous web is joined to the comb assembly on a feed path and the comb assembly is mounted on the lapping machine so as to be movable toward and away from the feed path.

6. A textile lapping machine as claimed in claim 5, wherein the angle between the comb assembly and the feed path is adjustable.

7. A textile lapping machine as claimed in claim 6, wherein the angle is 40-70°.

8. A textile lapping machine as claimed in claim 7, wherein the feed path of the fibrous web to the comb assembly is via an apron feed device from a card.

9. A textile lapping machine as claimed in claim 7, wherein the feed path of the fibrous web toward the comb assembly includes a feed plate adjacent the comb.

10. A textile lapping machine as claimed in claim 9, wherein the comb execution is a reciprocating path and the feed plate lies at an acute angle to the comb path.

11. A textile lapping machine as claimed in claim 1, wherein the comb assembly delivers the pleated web to a generally horizontal lapping zone defined by an upper generally planar guide surface and a lower guide surface contributed by a conveyor forming part of ancillary equipment with which the lapper is used.

12. A textile lapping machine as claimed in claim 11, wherein the lapping zone has an exit end and an entry end where the comb and press bar assemblies both act and the presser bar drive means has reciprocating parts which allow a parts exchange in order to adjust the stroke.

13. A textile lapping machine as claimed in claim 12, wherein the presser bar has a face from which rows of needles project forwardly toward the lapping zone.

14. A textile lapping machine as claimed in claim 13, wherein at least some of the needles are barbed.

15. A textile lapping machine as claimed in claim 13, wherein the presser bar has a face which is inclined in order to reach the upper guide surface before the lower guide surface during reciprocation.

16. A textile lapping machine as claimed in claim 11, wherein the presser bar assembly is adjustable toward and away from the comb assembly in order to adjust the depth of the lapping zone.

17. A textile lapping machine as claimed in claim 16, wherein the presser bar assembly is generally horizontal and mounted on a jacking mechanism supported on the lapping machine.

18. A textile lapping machine as claimed in claim 11, wherein the upper guide surface of the entry end of the lapping zone has teeth which in use project into the pleated fibrous web across the width of the lapping zone in order to resist the passage of the web through the zone and thereby promote the action of the presser bar.

19. A textile lapping machine as claimed in claim 18, wherein the upper guide surface of the lapping zone located downstream of the teeth include multiple fingers arranged parallel to the pleated webs direction of feed through the lapping zone.

20. A textile lapping machine as claimed in claim 18, wherein the height of the upper guide surface and the teeth are adjustable in unison in relation to the comb assembly in order to change the depth of the lapping zone.

21. A textile lapping machine as claimed in claim 18, wherein the teeth occupy 35-40 mm of the pleated web path in the lapping zone.

22. A textile lapping machine as claimed in claim 20, wherein the upper guide surface and the teeth are moveable as a unit toward and away from the comb and clampable in a selected position.

23. A textile lapping machine as claimed in claim 20, wherein the upper guide surface and the teeth are arranged to rise and fall in relation to the lower guide surface by a screw adjuster.

24. A textile lapping machine as claimed in claim 18, wherein the teeth are mounted on an exchangeable plate.

25. A textile lapping machine as claimed in claim 11, having a body with a projecting support for the lapper assembly and comb, the body defining a vacant space beneath the projecting support enabling the lapper and assembly to overlie the space.

26. A textile lapping machine as claimed in claim 25, wherein the conveyor has a feed roll and the comb path when produced is capable of intersecting the crown of the feed roll.

27. A textile lapping machine as claimed in claim 25 in combination with an oven served by an endless conveyor which includes rolls.

* * * * *